US006762408B1

(12) United States Patent
Read

(10) Patent No.: US 6,762,408 B1
(45) Date of Patent: Jul. 13, 2004

(54) ELECTRICALLY-CHARGED PARTICLE ENERGY ANALYZERS

(75) Inventor: Frank Henry Read, Macclesfield Forrest (GB)

(73) Assignee: Shimadzu Research Laboratory (Europe) Ltd., Manchester (GB)

( * ) Notice: Subject to any disclaimer, the term of this patent is extended or adjusted under 35 U.S.C. 154(b) by 0 days.

(21) Appl. No.: 10/009,280

(22) PCT Filed: Oct. 28, 1999

(86) PCT No.: PCT/GB99/03556

§ 371 (c)(1),
(2), (4) Date: May 13, 2002

(87) PCT Pub. No.: WO00/77504

PCT Pub. Date: Dec. 21, 2000

(30) Foreign Application Priority Data

Jun. 16, 1999 (GB) ..... 9914082
Jul. 15, 1999 (GB) ..... 9916654

(51) Int. Cl.[7] ..... H01J 49/00; H01J 49/22; H01J 40/00

(52) U.S. Cl. ..... 250/305; 250/396 R; 250/397

(58) Field of Search ..... 250/281–284, 250/294, 305

(56) References Cited

U.S. PATENT DOCUMENTS

| | | | | |
|---|---|---|---|---|
| 3,735,128 A | | 5/1973 | Palmberg | |
| 3,742,214 A | * | 6/1973 | Helmer et al. | 250/305 |
| 3,783,280 A | | 1/1974 | Watson | |
| 4,367,406 A | | 1/1983 | Franzen et al. | |
| 4,593,196 A | | 6/1986 | Yates | |
| 5,008,535 A | * | 4/1991 | Van Gorkom | 250/305 |
| 5,032,724 A | | 7/1991 | Gerlach et al. | |
| 5,594,244 A | * | 1/1997 | Prutton | 250/305 |

FOREIGN PATENT DOCUMENTS

| | | |
|---|---|---|
| DE | 2648-466 A1 | 10/1976 |
| DE | 4341144 A1 | 6/1995 |
| EP | 0 255 981 A1 | 2/1988 |
| GB | 1387173 | 3/1975 |
| WO | WO 99/35668 A2 | 7/1999 |

OTHER PUBLICATIONS

Hawkes, et al., Principle of Electron Optics, vol. 1, Basic Geometrical Optics, 1989, pp. 1–571 (including index pp. i xvii), Academic Press, Harcout Brace Jovanich, Publishers, England.

Hawkes, et al., Principle of Electron Optics, vol. 2, Applied Geometrical Optics, 1989, pp. 1–1188 (including index pp. i –xviii), Academic Press, Harcout Brace Jovanich, Publishers, England.

Bosch et al., "A simultaneous angle–resolved photoelectron spectrometer," *J. Phys. E:Sci. Instrum., 17*, pp. 1187–1192 (1984).

(List continued on next page.)

*Primary Examiner*—Melita Wells
*Assistant Examiner*—Christopher M. Kalivoda
(74) *Attorney, Agent, or Firm*—Leydig, Voit & Mayer, Ltd.

(57) ABSTRACT

A charged particle energy analyzer (FIG. 1) comprises a source of electrons 1 and inner and outer cylinders (2,3) arranged concentrically about a longitudinal axis (z—z). Electrical potential applied to the outer cylinder (3) creates an electrostatic field between the cylinders (2,3) defined by equipotentials which are symmetrical about the longitudinal axis z—z and increase linearly in the longitudinal direction and logarithmically in the radial direction. Electrons having different energies are focused by the electrostatic field at discrete positions spaced apart from each other in the longitudinal direction. Also described is a charged particle energy analyzer (FIG. 6) in which electrons having different energies are fcoused by the electrostatic field at discrete positions at a surface transverse to the longitudinal axis. Both analysers may operate in the second-order focusing mode.

60 Claims, 9 Drawing Sheets

OTHER PUBLICATIONS

Allenspach et al., "Spin–polarized Auger–electron spectroscopy," *Physical Review B, 35*:10, pp. 4801–4809 (1987).
Jacka et al., "A fast, parallel acquisition, electron energy analyzer: The hyperbolic field analyzer," *Rev. Sci. Instrum., 70*:5, pp. 2282–2287 (1999).
Risley, "Design Parameters for the Cylindrical Mirror Energy Analyzer," *Rev. Sci. Instrum., 43*:1, pp. 95–103 (1972).
Roy et al., "Design of electron spectrometers," *Rep. Prog. Phys., 53,* pp. 1621–1674 (1990).

* cited by examiner

ELECTRICALLY-CHARGED PARTICLE ENERGY ANALYZERS

FIELD OF THE INVENTION

This invention relates to charged particle energy analysers, particularly, though not exclusively, charged particle energy analysers having the capability to analyse simultaneously charged particles having a wide range of energies.

BACKGROUND OF THE INVENTION

In charged particle optical systems various devices are available for analysing the spectrum of energies of beams of charged particles and these devices have been comprehensively described in various works on the subject of charged particle optics; see for example, "Principles of Electron Optics" by P. H. Hawkes and E. Kasper (Academic Press, New York) 1989, and a paper by D. Roy and D. Tremblay, Rep Prog Phys. 53, 1621 (1990). In many applications, such as Auger electron spectroscopy of surfaces, the range of energies of interest in a single spectrum can cover more than an order of magnitude. The conventional way of obtaining such a spectrum has been to scan through the energy range using a single detector. A faster technique is to use a multidetector or series of detectors to cover an extended range of energies and then to scan the complete range of the spectrum either continuously or in steps. It seems that in all the known electrostatic charged particle energy analysers, with the exception of the hyperbolic field analyser, the range of energies that can be analysed at any one time is small, the ratio of the energy range to the mean energy being typically less than 0.1. Therefore, if the stepping method is used the required number of steps is at least of the order of 10.

It is clearly advantageous to be able to analyse the whole energy spectrum simultaneously. The hyperbolic field analyser described by M. Jacka, M. Kirk, M. El Gomati and M. Prutton in Rev. Sci. Instrum, 70, 2282 (1999) is able to do this. However, the hyperbolic field analyser has a substantially planar geometry and so suffers from the drawback that it is only able to analyse charged particles incident over a narrow angular range is azimuth.

SUMMARY OF THE INVENTION

According to a first aspect of the invention there is provided a charged particle energy analyser for analysing charged particles having a range of energies comprising, electrostatic focusing means having a longitudinal axis, a charged particle source for directing charged particles into an electrostatic focusing field generated, in use, by said electrostatic focusing means, and detection means for detecting charged particles focused by said electrostatic focusing means, wherein said electrostatic focusing field is defined by equipotentials which extend about said longitudinal axis over a predetermined range is azimuth and charged particles having different energies are brought to a focus by the electrostatic focusing field at different respective discrete positions.

Charged particle energy analysers according to this aspect of the invention have the capability to analyse simultaneously charged particles having a wide range of energies which are incident over the entire (360°) angular range in azimuth about the longitudinal axis or which are incident over one or more smaller azimuthal ranges. This combination of features enables the energy spectra of charged particles to be measured more rapidly than has been possible using known analysers, and also enables angular information to be obtained.

Charged particle energy analysers according to the invention may also be used in a second-order focusing mode whereby charged particles having a relatively narrow range of energies, but incident of a relatively wide angular range in elevation relative to the longitudinal axis can be focused.

According to another aspect of the invention there is provided a charged particle energy analyser for analysing charged particles comprising, electrostatic focusing means having a longitudinal axis, a charged particle source for directing charged particles into an electrostatic focusing field generated, in use, by said electrostatic focusing means, and detection means for detecting charged particles focused by said electrostatic focusing means, wherein said electrostatic focusing means is defined by equipotentials which extend about said longitudinal axis over a predetermined range in azimuth and said charged particle source directs said charged particles into said electrostatic focusing field over a predetermined angular range in elevation relative to said longitudinal axis, said predetermined angular range in elevation and/or the axial position of the charged particle source and/or the axial position of the electrostatic focusing field being set or adjustable for second-order focusing of charged particles.

BRIEF DESCRIPTION OF THE DRAWINGS

Embodiments of the invention are now described, by way of example only, with reference to the accompanying drawings, of which.

DESCRIPTION OF PREFERRED EMBODIMENTS

In the following description, the polarities of the applied potentials are chosen for the analysis of negatively-charged particles, and in the embodiments of FIGS. 1 to 10 the charged particles are assumed to be electrons. It will, of course, be appreciated that positively-charged particles may be analysed by reversing the polarities of the applied potentials.

Figure 1:
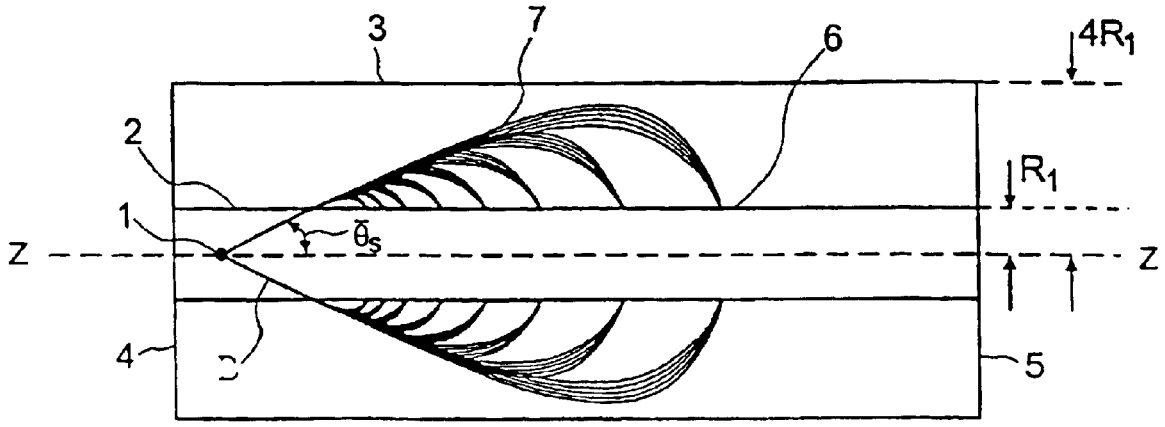
FIG. 1 is a schematic, longitudinal sectional view of a first embodiment of a charged particle energy analyser according to the invention.
Figure 2:
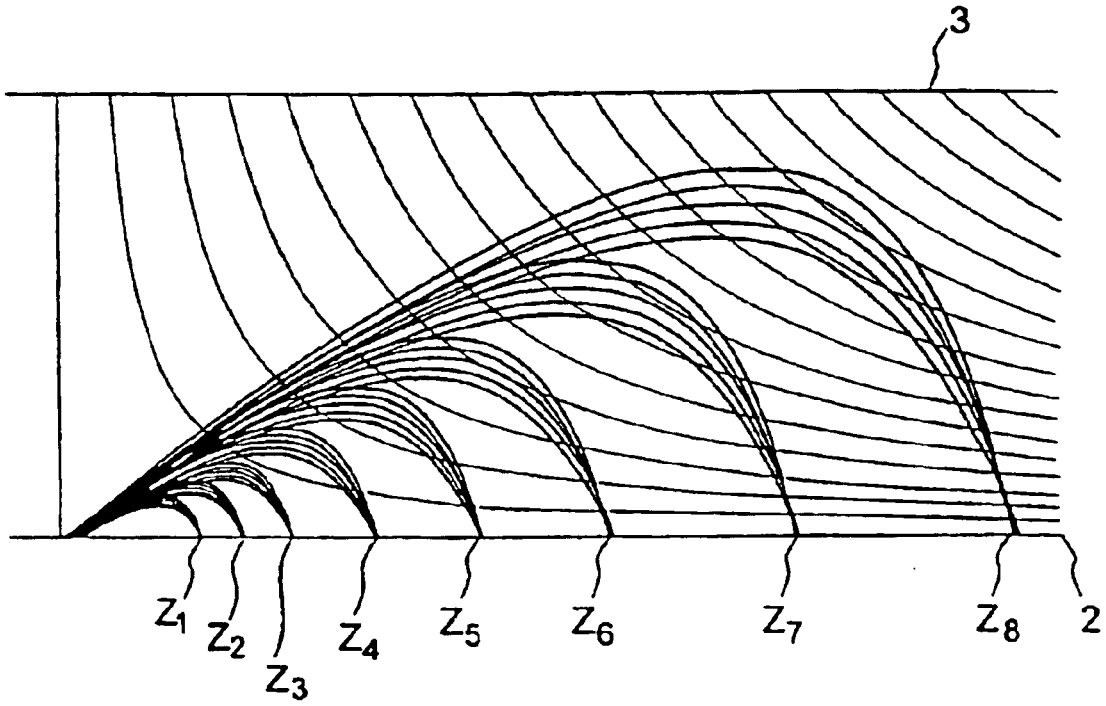
FIG. 2 is an enlarged view of a part of the charged particle energy analyser of FIG. 1 showing the contours of equipotentials in the range from 0 to −3200 V, in steps of 200 V.

Referring now to FIGS. 1 and 2 of the drawings, the charged particle energy analyser has cylinder symmetry about a longitudinal axis z—z. The analyser comprises a localised source of electrons 1 situated on that axis, an inner cylinder 2 of radius $R_1$ at ground potential, an outer cylinder 3 of radius $R_2=4R_1$ whose ends have axial coordinates $z=-3R_1$ and $15R_1$ to which is applied a potential drop that varies linearly from +1039.7 V to −5198.6 V at the left- and right-hand ends respectively, a first annular end disc 4 to which is applied a potential drop that varies from +1039.7 V at its outer edge to the ground potential at its inner edge, a second annular disc 5 to which is applied a potential drop that varies from −5198.6 V at its outer edge to the ground potential at its inner edge, and a detector 6 of electrons that forms a part of the outer surface of the inner cylinder 2 or conforms to a part of that surface. FIG. 1 also shows some representative curved trajectories 7 of electrons that originate at the localised source 1 and are focused onto the detector 6 by the electrostatic focusing field created between the inner and outer cylinders 2,3. In this illustration, electrons having the initial energies 125, 200, 300, 500, 800, 1250, 2000 and 3000 eV are focused at successive axial positions $z_1$, $z_2$ . . . $z_8$ in the longitudinal direction.

In this example, the potentials applied to cylinders 2,3 are given by equation (1) below, where W=346.57 V (=2501n4). The potentials applied to the annular end discs 4,5 are also given by equation (1) and are non-linear. It can be seen from equation 1 that the equipotentials between cylinders 2,3 vary monotonically (in this case linearly) in the longitudinal direction and logorithmically in the radial direction.

In practice, the annular end discs 4,5 may be made from a material of high electrical resistivity. Alternatively, instead of using a disc, the required potential drop could be implemented using a plurality of concentric, annular rings each maintained at a different uniform potential. The axial position of source 1 is $z_s=1.85R_1$, the medial elevational launch angle $\overline{\theta}_s$ of the electron beam B is 0.472 rad (27.04°) relative to the longitudinal axis z—z and the half-angle of the beam is 0.016 rad (0.91°). The angular extent in elevation of the beam may be controlled by an aperture or apertures provided in a mask (not shown) located between the source 1 and the inner cylinder 2. The potential of the inner cylinder 2 is 0 V and, in this embodiment, the beam is assumed to pass through a fine mesh or grid that covers the entrance region of the inner cylinder 2.

The properties of the analyser are of course unchanged if the applied potentials and the energies are scaled linearly together.

As already described, the potential applied to the outer cylinder 3 varies linearly from +1039.7 V at the left hand end to −5198.6 V at the right hand end. This linear variation in potential can be implemented by means of a cylinder 3 made from a material of high resistivity or, alternatively, the required potential may be simulated by means of a plurality of electrically conductive loops or rings, each of which is maintained at a different uniform potential. The inner cylinder 2 which is maintained at ground potential may be made from electrically conductive material. The distribution of potential in the region between cylinders 2,3 is uniform as a function of azimuthal angle about the longitudinal axis z—z. The potential $\phi(r,z)$ can be expressed in terms of the radial and axial coordinates (r,z) by the expression:

$$\phi(r,z)=-WzInr/1nR_2 \tag{1}$$

where z, r and $R_2$ are all expressed in units of $R_1$.

Because an analytical solution to the equations of motion in the electrostatic field appear not to exist, the accurate CPO-2D program available on web site http://cpo.ph.man.uk has been used to solve Laplace's equation for various practical systems and to integrate the equations of motion to obtain particle trajectories.

Referring again to FIGS. 1 and 2, electrons emanating from source 1 on the longitudinal axis z—z are focused on the surface of the inner cylinder 2 after energy analysis and the electrons are detected there by a curved detector array 6 that conforms to or forms part of the surface of the inner cylinder 2.

As will be described in greater detail hereinafter, the electron beam B spans a predetermined angular range in azimuth about the longitudinal axis z—z. The angular range may be the entire (360°) azimuthal range or one or more smaller azimuthal ranges, and detector 6 may be so located and configured as to detect for electrons in one or more of these angular ranges. Detector 6 may take the form of a microchannel array detector or a microsphere plate detector or a position-sensitive resistive plate detector or any other suitable form of detector.

In a particular embodiment, the charged particle source 1 comprises a target located on the longitudinal axis z—z and an irradiation device for directing radiation onto the target to generate charged particles. The irradiation device may, for example, be an electron gun and may be located within the inner cylinder 2.

In practice, the trajectories of charged particles having the same energy but different elevational angles may be subject to dispersion caused by their exposure to slightly differing field intensities in the region between the inner and outer cylinders 2,3, and this reduces the sharpness of the focused image. However, the axial position $z_s$ of the source 1 and the medial, elevational launch angle $\overline{\theta}_s$ of the charged particle beam can be optimised to minimise the dispersive effect of the electrostatic field over the entire energy range of interest.

The axial position $z_i$ of the image fonned by charged particles of energy $E_i$ can be expressed as:

$$z_i=c_0+c_2(\theta_s-\theta_0)^2 \ldots, \tag{2}$$

where $c_0$ is the axial position of the image if there is no dispersion, $c_2$ is a constant, $\theta_0$ is the elevational launch angle needed to bring the charged particles to a focus at the axial position $c_0$ when dispersion is present and $\theta_s$ is the launch angle of the trajectory of a charged particle within the beam.

The optimal condition exists when $\theta_0$ is constant over the entire energy range of interest and in the embodiment described with reference to FIG. 1 this condition is almost satisfied when $z_s$ is set at $-1.85R_1$. Table 1 lists the resultant values of $\theta_0$ and $z_i$ obtained using this setting for eight different energies, namely 125 eV, 200 eV, 300 eV, 500 eV, 800 eV, 1250 eV, 2000 eV and 3000 eV. A suitable medial launch angle $\overline{\theta}_s$ is then 0.472 rad (27.04°).

As can be seen from this Table, the values of $\theta_0$ are approximately constant over the whole energy range, the slight inconstancy of $\theta_0$ being less than the typical range of angles accepted from a source.

A plot of exemplary trajectories is shown in FIG. 1, and these same trajectories are shown in FIG. 2 on an enlarged scale together with the contours of selected equipotentials.

Table 1 also includes values of the relative energy dispersion $Edz_f/dE$ (normalised with respect to $R_1$) and a set of energy resolutions $\Delta E$ (normalised with respect to W), and these parameters are now defined.

It will be apparent from equation 2 above that the spread $\Delta z_i$ in the axial position of an image at each energy $E_i$ is given by the expression:

$$\Delta z_i = |c_2|(\Delta\theta_{max})^2 \tag{3}$$

where $\Delta\theta_{max}$ is the maximum angular deviation of trajectories (in a given range) from $\theta_0$ for that energy. This spread in axial position is approximately equivalent to an energy spread$\Delta E$ given by the expression:

$$\Delta E = 0.5\Delta z_f \Big/ \frac{dz}{dE}, \tag{4}$$

where the factor 0.5 is used as an approximation to convert the base energy width to the width at half height of a peak. As will be clear from the values of $\Delta E$ listed in the last column of Table 1, the useful energy range in this example covers at least a factor of 10.

For the source position $z_s$ that has been used ($-1.85R_1$) $\theta_0$ is stationary (in fact a maximum) when the initial energy E is approximately 1000 eV. It might be useful in practice to change the value of E for which $\theta_0$ is stationary by varying $z_s$. This would give some control over the dependence of $\Delta E$ on E. In practice, adjustments of $z_s$ may be facilitated by physically adjusting the axial position of the source 1 or by, in effect, axially translating the electrostatic field relative to the source by changing the axial position at which zero potential is applied to the outer cylinder.

Other parameters could be varied to make $\theta_0$ more constant. In particular the linear variation of the voltage on the outer cylinder could be replaced by a slightly non-linear (but monotonic) variation, the parameters of which would be adjusted to minimise the fluctuations in $\theta_0$. Alternatively, the shapes of the electrodes could be changed, for example by using conically-shaped electrodes in place of discs and cylinders.

The analyser described with reference to FIGS. 1 and 2 generates an electrostatic focusing field which is uniform as a function of azimuthal angle about the longitudinal axis. However, this need not necessarily be the case; alternatively, the field may have n-fold rotational symmetry about the longitudinal axis, where n is an integer. Such a field could be generated by replacing the inner cylinder with a tubular member having n-fold symmetry, such as a flat-sided electrode having a polygonal transverse cross-section. This configuration has the advantage that a detector can be readily located on one or more of the flat sides.

In another implementation of the invention, the outer cylinder is replaced by a curved axially symmetric plate to which a (possibly uniform) potential is applied and which is appropriately shaped to create equipotentials which vary monotonically in the longitudinal direction, such as the linearly varying equipotentials generated by the inner and outer cylinders 2,3 of the embodiment described with reference to FIGS. 1 and 2.

In the embodiment of FIG. 1, the inner cylinder 2 has a window or windows by which electrons are admitted to the electrostatic focusing field. The window or each window is so dimensioned and shaped as to define a beam having required angular range in azimuth, and is covered by a fine mesh or grid to help eliminate edge effects. The mesh could, for example, consist of a square array of holes or could be made from parallel wires extending in the longitudinal z direction that are stretched across the window. The shielding properties of both these types of mesh are known, as are the defocusing effects that the meshes produce. The defocusing is effectively equivalent to increasing the size of the source.

Alternatively, the annular range in azimuth could be defined by an aperture or apertures provided in a mask (not shown) located between the source 1 and the inner cylinder 2.

Figure 3:
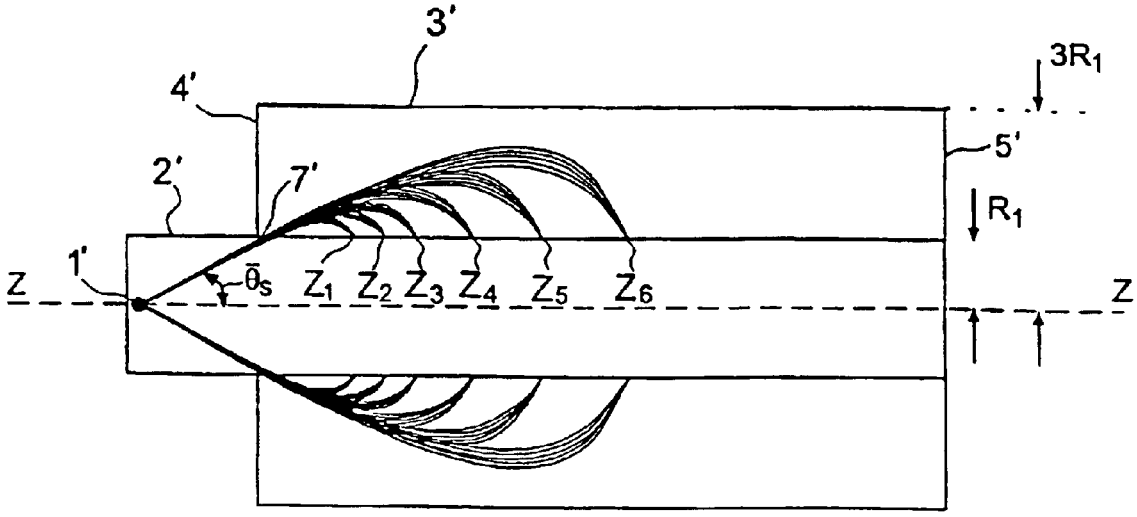
FIG. 3 is a schematic, longitudinal sectional view of a second embodiment of a charged particle energy analyser according to the invention.

In some practical applications it might be more convenient to use an open window, having the form of a slot in the azimuthal direction. In another embodiment shown in FIG. 3, electrons enter the electrostatic focusing field through an open slot 7' in the inner cylinder 2' extending between the axial coordinates $z=0.05R_1$ and $0.24R_1$. The outer cylinder 3' has a radius of $3R_1$ (in units of the radius of the inner cylinder) and extends between the axial coordinates z=0 and $z=10R_1$. A left-hand end is closed by a disc at ground potential. As before, the potentials applied to the outer cylinder and a right-hand end disc are given by equation (1), but where W=274.65 V (=2501n3). By application of the above-described analysis based on Equation 2 above, the optimal axial position of the source 1' is found to be $-1.8R_1$ and the optimal medial elevational launch angle $\overline{\theta}_s$ is found to be 0.476 rad (27.25°). The results of this analysis are shown in Table 2, and some exemplary trajectories are illustrated in FIG. 3, where electrons having the initial energies 125 eV, 200 eV, 300 eV, 800 eV, 1250 eV and 2000 eV are focused at successive axial positions $z_1, z_2 \ldots z_6$ in the longitudinal direction. By comparing the data in Tables 1 and 2 it can be seen that the values of $\theta_0$ vary less when the entrance aperture is open. This form of the analyser is however less suitable when second-order focusing is required, as will be discussed below.

Other positions of the electron source and the image are envisaged. The source and the image may both be located at the surface of the inner cylinder 2 (surface-to-surface focusing) or, alternatively, the source and the image may both be located on the longitudinal axis z—z (axis-to-axis focusing). Alternatively, the source could be located in a field-free region between the longitudinal axis z—z and the inner cylinder 2 and the image could also be located between the longitudinal axis and the inner cylinder 2 or radially outwards of the inner cylinder.

The source of electrons may, in effect, be a virtual source; in this case, the source directs electrons into the electrostatic focusing field from a location or locations offset from the longitudinal axis and includes suitable focusing means, which could be in the form of one or more conical lens, for example, for focusing electrons emitted from a real source (which may be located on-axis) at said location or locations.

Similarly, such focusing means may be used to focus electrons forming an image onto one or more detector spaced apart from the image.

In another mode of operation, charged particle energy analysers according to the invention can be arranged to analyse charged particles in a relatively narrow energy band incident over a relatively wide angular range in elevation.

One of the main advantages of a conventional Cylindrical Mirror Analyser (CMA), as described, for example, by J. S.

Risley in Rev. Sci. Instrum. 43, 95 (1972) is that it can be operated with second-order focusing. That is, it is possible to find conditions for which the axial position $z_i$ of the focus point has a dependence on the elevational launch angle $\theta_s$ of a charged particle of the form $$z_i=c_0+c_2(\theta_s-\theta_0)^2+c_3(\theta_s-\theta_0)^3+\ldots \quad (5)$$

where the second-order term is zero. The absence of the usual quadratic term implies that a wide range of angles $\theta_s$ can be accepted for a given energy resolution of the analyser, provided that the coefficient $c_3$ is not too large.

Figure 4:
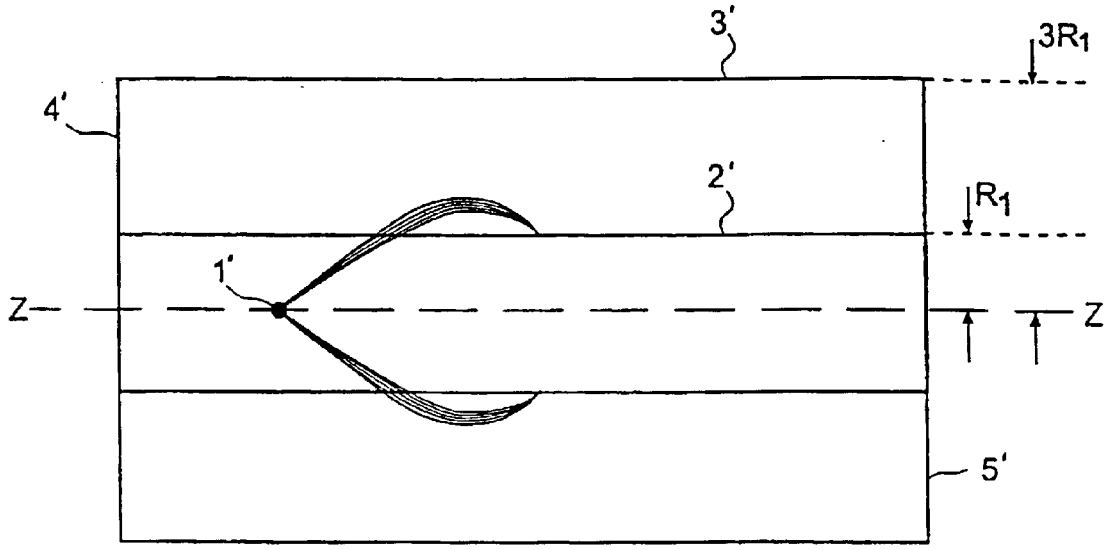
FIG. 4 is a schematic, longitudinal sectional view of a third embodiment of a charged particle energy analyser according to the invention operating in a second-order, axis-to-surface focusing mode.

FIG. 4 shows an embodiment of a charged particle energy analyser according to the invention operating in this second-order focusing mode.

Here, the dimensions of the analyser and the applied voltages are exactly the same as for the analyser described with reference to FIG. 3, but differs in that a fine mesh is placed across the entrance window in the inner cylinder 2' and in that the axial position $z_s$ of the source 1' is $2R_1$. It is found by analysis that the quadratic term in Equation 5 becomes zero when E=854 eV and when the medial launch angle $\overline{\theta}_s$=0.622 rad (35.6°). In this embodiment, the half angle of the beam is 0.05 rad (2.86°).

In fact, a continuous spectrum of such conditions exists. For a given source position $z_s$ (within some range) it is possible to find values of E and $\overline{\theta}_s$ that give second-order axis-to-surface focusing. Some results are shown in Table 3.

Figure 5:
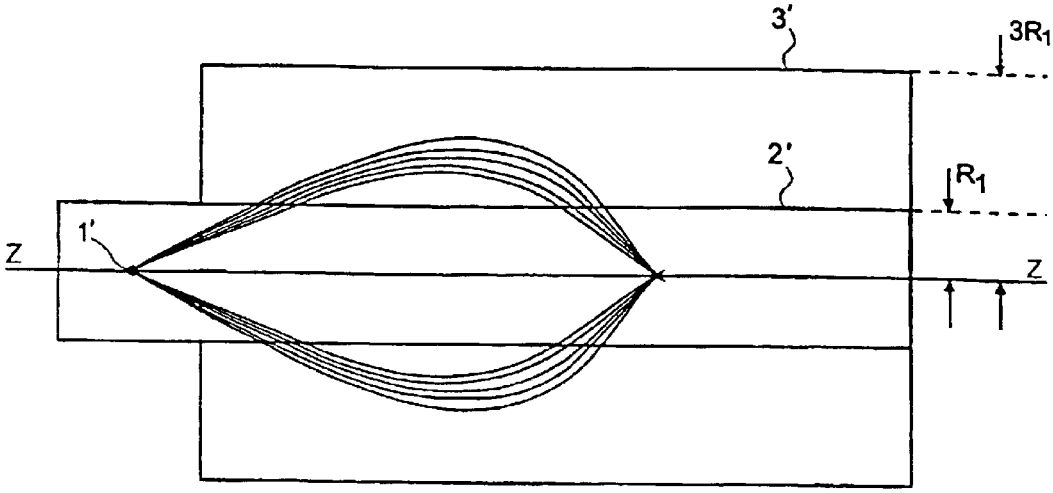
FIG. 5 is a schematic, longitudinal sectional view of a fourth embodiment of a charged particle energy analyser according to the invention operating in a second-order, axis-to-axis focusing mode.

Second-order focusing may also be performed in the axis-to-axis mode, and this is shown in FIG. 5. The dimensions of the analyser and the applied voltages are exactly the same as the analyser described with reference to FIG. 4, but differs therefrom in that the axial position $z_s$ of the source is $-R_1$. Again, a fine mesh is placed across the entrance window in the inner cylinder 2'. It is found by analysis that the quadratic term in Equation 5 becomes zero when E=1345.5 eV and the medial elevational launch angle $\overline{\theta}_s$ of the beam is 0.444 rad (25.46°). In this embodiment, the half angle of the beam is 0.05 rad (2.86°). Again a continuous spectrum of such conditions exists, as shown in Table 4.

As with the conventional CMA, a continuous spectrum of other modes of operation is possible and it is envisaged that second-order focusing might also be achievable when the entrance window is open. It is also possible to find conditions for which the energy resolution is optimised for a particular narrow range of energies.

Figure 6:
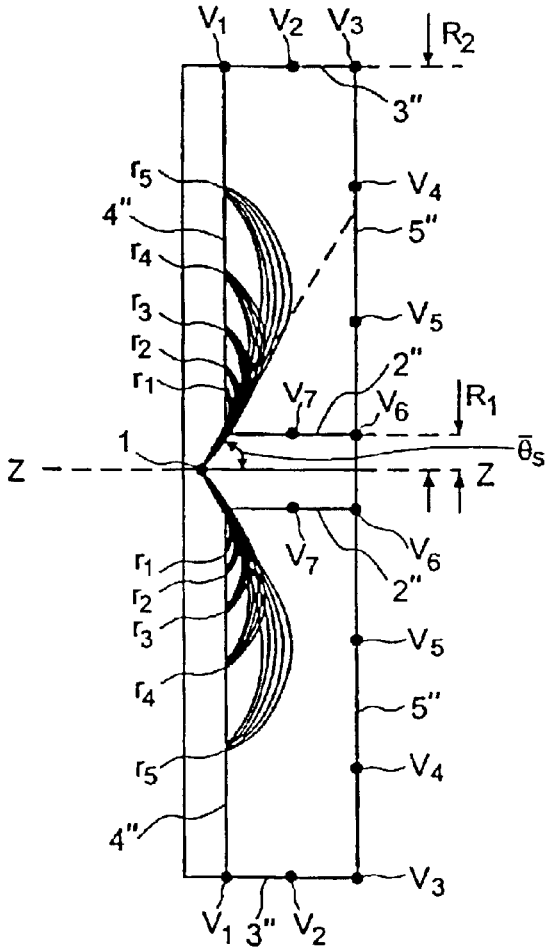
FIG. 6 is a schematic longitudinal sectional view of a fifth embodiment of a charged particle energy analyser according to the invention.

FIG. 6 of the drawings shows another embodiment of a charged particle energy analyser according to the invention. As before, the polarities of the applied potentials are chosen for the analysis of negatively-charged particles, assumed to be electrons in this embodiment. However, positively-charged particles may be analysed by reversing the polarities of the applied potentials.

In contrast to the embodiments described with reference to FIGS. 1 to 3, the charged particle analyser of FIG. 6 is effective to focus electrons having different energies $E_i$ at different respective radial positions $r_i$ in a plane transverse to the longitudinal axis z—z. This arrangement has the advantage that a flat detector, which may be disc-shaped, can be used.

The analyser of FIG. 6 has substantially the same geometrical configuration as the analysers described with reference to FIGS. 1 to 3, comprising inner and outer cylinders 2",3" and a pair of annular end discs 4",5". As before, the potential $\phi(R_2,z)$ applied to the outer cylinder 3", where $R_2$ is the radius of the outer cylinder, varies linearly as a function of the axial coordinate z according to the expression:

$$\phi(R_2,z)=-Wz,$$

where z is expressed in units of the radius $R_1$ of the inner cylinder 2". As before, the distribution of potential $\phi(r,z)$ between the cylinders 2",3" can be expressed in terms of the radial and axial coordinate (r,z) by equation 1 above from which it can be seen that the equipotentials between cylinders 2",3" vary monotonically (in this case linearly) in the longitudinal direction and logarithmically in the radial direction. Again, the distribution of potential $\phi(r,z)$ is uniform as a function of azimuthal angle about the longitudinal axis z—z.

In the case of the analysers described with reference to FIGS. 1 to 3, the medial elevational launch angle $\overline{\theta}_s$ of the electron beam B relative to the longitudinal axis z—z is typically around 25°. However, in the case of the analyser of FIG. 6, the medial elevational launch angle $\overline{\theta}_s$ is much larger, and is typically around 60°, although other angles in the range 50° to 70° say could be used.

As shown in FIG. 6, an electron beam B which enters the electrostatic focusing field at a relatively large medial elevational launch angle $\overline{\theta}_s$ is deflected away from the longitudinal axis z—z and, in this embodiment, is brought to a focus in the plane of the left-hand end disc 4", where one or more flat detectors can be positioned.

The electron beam B may span a predetermined angular range in azimuth around the longitudinal axis z—z, which may be the entire (360°) azimuthal range or one or more smaller azimuthal range. As before, the required azimuthal range may be defined by one or more suitably dimensioned and shaped window in the inner cylinder 2" and/or end disc 4" or by a mask or masks located between the source and the inner cylinder.

For a given energy, electrons are brought to a focus on a respective arc or arcs in the focal plane and in the case of a beam spanning the entire azimuthal range the electrons are brought to a focus on a circle. One or more suitable detectors would be so positioned and configured as to detect for focused electrons in the or each azimuthal range.

In this embodiment, the radius $R_2$ of the outer cylinder 3" is $10R_1$ and the ends of the inner and outer cylinders have the axial coordinates z=0 and z=$3R_1$. The value of W in equations 1 and 6 above is set at 333.3 V and the potential applied to the inner cylinder 2" and to the left-hand end disc 4" is set at 0 V, whereas the potential applied to the outer cylinder 3" varies linearly from 0 V at the left-hand end to −1000 V at the right-hand end.

In this embodiment, the electron beam is produced by a localised electron source 1" positioned on the longitudinal axis z—z in a field-free region at the axial position $z_s=-0.6R_1$.

FIG. 6 shows some representative curved trajectories of electrons that are focused in the transverse plane of the left-hand end disc 4". In this illustration, electrons having initial energies 40, 80, 160, 320 and 640 eV are all approximately focused at successive radial positions $r_1,r_2,r_3,r_4,r_5$ in the transverse focal plane. In this embodiment, the medial elevational launch angle of the electron beam B is 61.8° and the half-angle of the beam is 3.8°, and the beam enters the electrostatic focusing field where the inner cylinder 2" and the left-hand end disc 4" meet via a window in the form of an electrically conductive grid or mesh.

As already described, the potential applied to the outer cylinder 3" varies linearly from 0 V at the left hand end to −1000 V at the right hand end. This linear variation in potential can be implemented by means of a cylinder 3"

made from a material of high electrical resistivity across which the potential drop is applied. Alternatively, the required potential may be simulated by means of a plurality of electrically conductive loops or rings, each of which is maintained at a different uniform potential. The inner cylinder 2" which is maintained at ground potential could be made from electrically conductive material.

The non-uniform potential on the right-hand disc 5" may be created by applying a potential drop across a disc made from a material of high electrical resistivity. Alternatively, instead of using a disc the required variation of potential could be simulated using a plurality of concentric rings each maintained at different uniform potential. In another alternative approach the required potential may be simulated in piece-wise fashion using the afore-mentioned CPO-2D program by applying the required potential at a number (e.g. 30) positions on the disc that are equally spaced radially and arranging for the potential to vary linearly between neighbouring positions.

Figure 7:
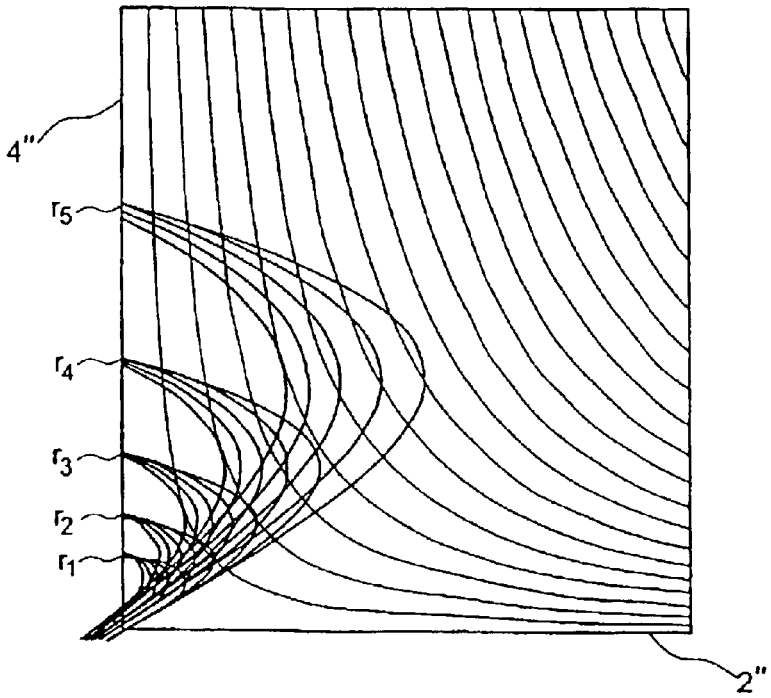
FIG. 7 is an enlarged view of part of the charged particle energy analyser of FIG. 6 showing the contours of equipotentials in the range from −50 to −950 V in steps of 50 V.

FIG. 7 shows the trajectories of FIG. 6 on an enlarged scale and with a different aspect ratio, and also shows the contours of equipotentials in the range −50 V to −950 V, in steps of 50 V.

It is apparent from FIG. 7 that lower energy electrons are brought to a focus slightly in front of a detector located in the plane of the left-hand end disc 4" whereas higher energy electrons are brought to a focus slightly behind the detector.

It has been found that the axial position $z_s$ of the source does not have any significant effect upon the quality of the focus obtained. However, significant improvements in the quality of the focus can be achieved by slightly modifying the potential distribution $\phi(r,z)$ defined by equation 1 above.

This can be accomplished empirically by optimising the potentials applied at selected positions on the inner and outer cylinders 2",3" and on the right-hand end disc 5" while maintaining the left-hand end disc 4" at 0 V, and arranging for the potential between these selected positions to vary linearly as a function of axial and radial distance respectively.

In this particular example, the selected positions on the right-hand end disc 5" have the radial coordinates r=1, 3, 6 and 9 and the selected positions on the inner and outer cylinders 2",3" have the axial coordinates z=0, 1.5 and 3, where these coordinates are expressed in units of $R_1$.

The radial and axial coordinates of the selected positions are summarised in the first and second rows respectively of Table 5 and the respective voltages $V_1$, $V_2$ . . . $V_7$ applied at each selected position are shown in the third row of the table. These voltages are also shown in FIG. 6.

The potential $V_1$ at the left-hand end of each cylinder is 0 V and it is found to be desirable to fix the potential $V_3$ at the right-hand end of the outer cylinder 3", at −1000 V in this example.

The remaining five potentials $V_2$, $V_4$, $V_5$, $V_6$ and $V_7$ are treated as variables and are automatically adjusted using the aforementioned CPO-2D program in the "automatic free-focus iteration" mode to optimize (i.e. minimise) the sizes of the focal points in the plane of the detector, while allowing the radial positions of the focal points to change.

The fourth row in Table 5 shows the voltage values that are derived from equation 1 above, whereas the fifth row in the table shows the modified values optimised by empirical adjustment.

It will be appreciated that this optimisation procedure could also be applied to the analysers described with reference to FIGS. 1 to 5.

Figure 8:
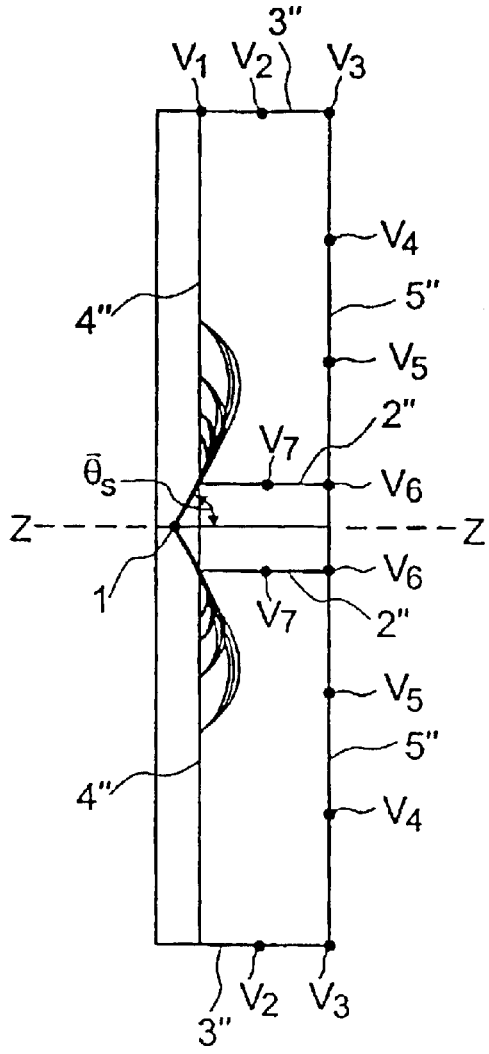
FIG. 8 is a schematic longitudinal sectional view of a sixth embodiment of a charged particle energy analyser according to the invention.

FIG. 8 shows the electron trajectories obtained using the optimised voltage values. In this illustration the electrons have the initial energies 40, 80, 160, and 320 eV which form a geometric progression with a multiplying factor of 2 and cover an energy range of 1:8. In this case the medial elevational launch angle $\overline{\theta}_s$ is 60.8° and the half angle the beam is 2.05°. As before, the optimum axial position of the source is $z_s=-0.6R_1$.

Figure 9:
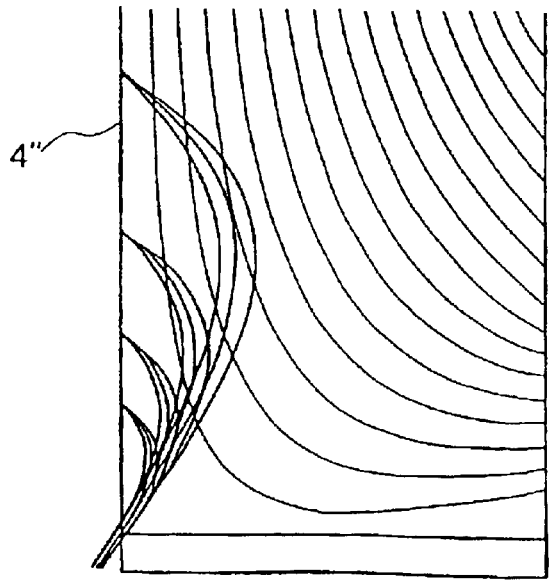
FIG. 9 is an enlarged view of part of the charged particle energy analyser of FIG. 8 showing the contours of equipotentials in the range from −50 V to −800 V in steps of 50 V.

FIG. 9 shows the trajectories of FIG. 8 on an enlarged scale and with a different aspect ratio, and also shows the contours of equipotentials in the range −50 V to −800 V in steps of 50 V.

A comparison of FIGS. 7 and 9 clearly shows that much smaller focal spot sizes are attained using the empirically adjusted voltage values. Also, the contours of the equipotentials have a somewhat different shape.

Further improvements to the quality of the focus may be made by optimising a larger number of voltages. Alternatively, or additionally, improvements may be made using different electrode shapes; for example, the outer cylinder 3" could be replaced by an appropriately shaped curved, axially symmetric plate to which a (possibly uniform) potential is applied. Such a plate could also be used to generate a potential distribution $\phi(z,r)$ of the form defined by equation 1.

Alternatively, instead of modifying the potential distribution $\phi(z,r)$, the detector may be suitably shaped and positioned to conform to the surface at which the electrons are focused. Furthermore, the electrons need not be focused in the plane of the end disc, but could be focused on some other transversely extending surface which could be in a field free region beyond the end disc 4" and need not necessarily be flat; the surface could, for example, have a conical shape. The above-described optimisation procedure could be used to improve the quality of the focus at a desired surface.

By analogy to equation 2 above, the radial position $r_i$ at which the trajectory of an electron of energy $E_i$ intersects the focal plane can be expressed as:

$$r_i=c_0+c_2(\theta_s-\theta_0)^2+\ldots$$

where $c_0$ and $c_2$ are coefficients which are a function of energy, $\theta_s$ is the elevational launch angle of an electron in the beam and $\theta_0$ is the elevational launch angle needed to bring the electron to a focus when energy dispersion is present. For values of $\theta_s$ near to $\theta_0$ a first-order focus exists at $r_i=c_0$.

Table 6 summarises the values of $\theta_0$, $r_i$ and $c_2$ obtained using the analyser of FIG. 8 for electrons having the energies 56.6, 80, 113.1, 160, 226.3, 320, 452.5 and 640 eV and for a source having the axial position $z_s=-0.6R_1$. Also shown in Table 6 are computed values of relative energy dispersion $Edr_i/dE$ and the dimensionless figure of merit $g_2$, given by the expression:

$$g_2=c_2^{-1}Edr_i/dE.$$

The values of $r_i$, $c_2$ and $Edr_i/dE$ in this table are expressed in units of $R_1$.

The optimum condition exists when $\theta_0$ is constant over the entire energy range and it can be seen from the values of $\theta_0$ listed in Table 6 that this condition is almost satisfied. The variation in the values of $\theta_0$ is less than the typical half angle of the beam, and this variation is even smaller over a narrower energy range. The variation is particularly small (0.2°) in the energy range from approximately 100 eV to 450 eV.

As shown in Table 6, the values of $\theta_0$ decrease monotonically as energy E increases. This behaviour can be altered by changing the axial position of the source. For example, a shallow minimum in $\theta_0$ exists when the axial source position $z_s=-0.7R_i$ (i.e. $\theta_0=1.081$, 1.069, and 1.071 at energies E=80, 226 and 640 eV respectively). However, in this case, the coefficient $c_2$ is too small to allow a maximum in $r_i$ at energies E<80 eV, but there is approximate second-order focusing at these energy values and so the focal spot size is still relatively small. Therefore, there may be some benefit in adjusting the source position, but in practice the optimum position will depend on the application to which the analyser is being put.

For a source position $z_s=-0.6R_i$, the values of $r_i$ can be approximately parametrized by the expression:

$$lnr_i=a+blnE+c(lnE)^2,$$

where the constants a,b and c are 0.02353, 0.06433 and 0.03643 respectively.

The charged particle energy analysers described with reference to FIGS. 6 to 9 can also operate in the second order focusing mode whereby a relatively narrow band of energies can be analysed with improved energy resolution.

Second order focusing occurs when the quadratic term in equation 7 above is zero, and in this condition the radial position $r_i$ at which the trajectory of an electron intersects the focal plane can be expressed as:

$$r_i=c_0+c_3(\theta_s-\theta_0)^{3+}\ldots,$$

where the coefficients $c_0$ and $c_3$ depend on energy. In this situation, the angular range in elevation that can be accepted is larger for a given energy resolution.

Figure 10:
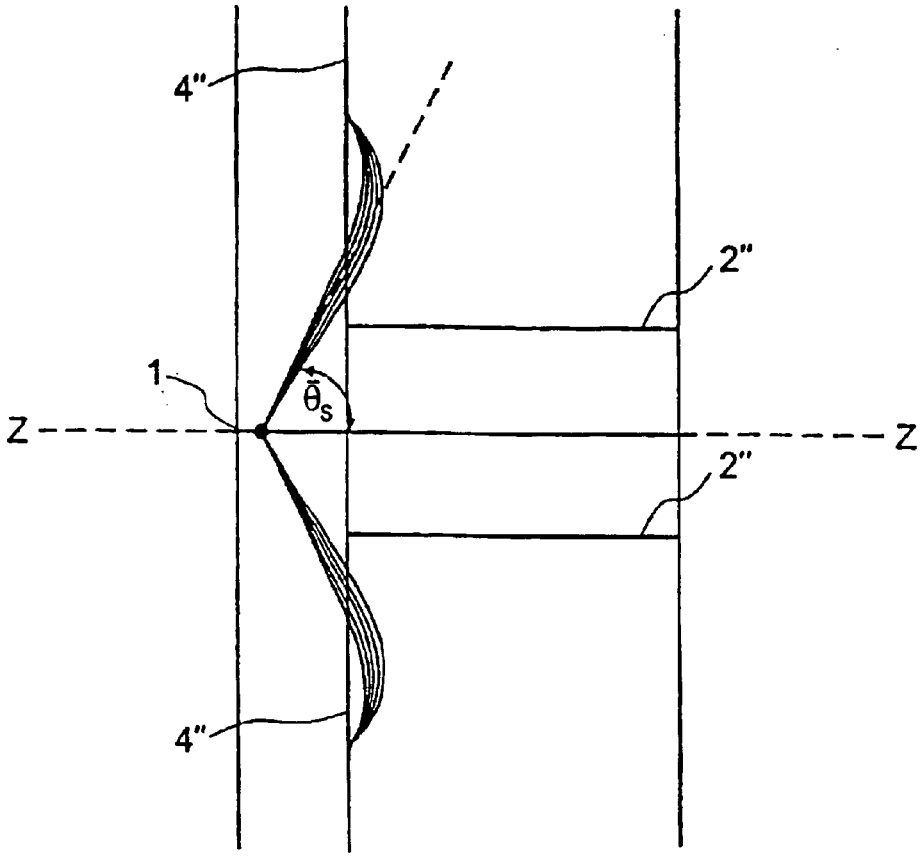
FIG. 10 is a schematic longitudinal sectional view of a seventh embodiment of a charged particle energy analyser according to the invention operating in a second-order focusing mode.

FIG. 10 shows an analyser operating in the second-order focusing mode. The geometrical configuration of the analyser and the applied potentials are exactly as described with reference to FIG. 8; however, the axial position of the source is set at $z_s=-0.8R_1$. It is found that the quadratic term becomes zero, and second-order focusing takes place, when the energy E=97.02 eV and the elevational launch angle $\theta_0=62.6°$. In the analyser of FIG. 10, the medial elevational launch angle $\overline{\theta}_s$ of the electron beam is 62.2°, the half angle of the beam is 3.7° and the beam enters the electrostatic field region via a window in the left-hand end disc 2" in the form of an electrically conductive grid or mesh.

A contiuous spectrum of the conditions for second-order focusing exists. Thus, for a given source position $z_s$ (within some limited range) it is possible to find values of E and $\theta_0$ that satisfy the conditions for second-order focusing and some values are listed in Table 7. Also shown in this table are values of the relative energy dispersion $Edr_i/dE$ and the figure of merit $g_2$.

It can be seen from Table 7 that when the source positions $z_s=-0.6R_1$, second order focusing takes place when the energy is 38.4 eV which is just below the lower energy limit (40 eV) of the analysers described with reference to FIGS. 6 to 8 when operating in the 'wide-energy' first order focusing mode illustrated in those Figures.

Accordingly, in this situation, where the axial source position is fixed, it is possible to use the first order, 'wide-energy' focusing mode in combination with the second-order focusing mode.

Initially, the first order, wide-energy focusing mode would be used to produce a relatively wide energy spectrum of the charged particles in the beam, and the applied potentials would then be scaled appropriately to produce high-resolution, second-order focusing in a selected narrow energy range in the spectrum.

As will be clear from Table 7, second order focusing occurs at relatively small values of $r_i$. Accordingly, when the first and second order modes of operation are used in combination the inner radial part of the analyser would be used predominantly for second order focusing whereas the outer parts of the detector would only be used for wide-energy, first-order focusing as shown in FIGS. 6 and 8.

In the embodiments described with reference to FIGS. 1 to 10, the inner and outer field defining elements extend over the entire (360°) angular range in azimuth around the longitudinal axis z—z.

Figure 11A:
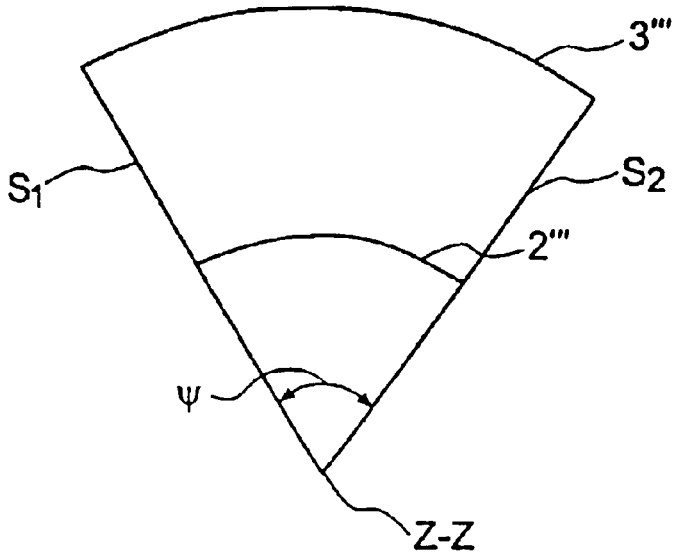
FIG. 11*a* shows a transverse cross-sectional view through an eighth embodiment of a charged particle energy analyser according to the invention.

However, alternatively, the inner and outer field defining elements may extend over a smaller azimuthal range. An example of this is shown in FIG. 11*a*. This figure shows a transverse cross-sectional view through inner and outer field defining elements 2"',3"' in the form of cylindrical segments subtending an angle ψ at the longitudinal axis, which in this example is about 60°. The arcuate end edges of the cylindrical segments are joined by end walls in the form of annular sectors and the longitudinally extending side edges of the cylindrical segments are joined by flat side walls $S_1$, $S_2$.

The electrostatic focusing field created within this structure may have exactly the same form as that described with reference to FIGS. 1 to 10 provided the potential distribution at the side walls is correct (as defined by Equation 1 above, for example). The required potential distribution can be achieved in a variety of different ways. For example, the side walls may be made from a material of high electrical resistivity and the required potentials are applied at different points along the edges of the side walls.

Figure 11B:
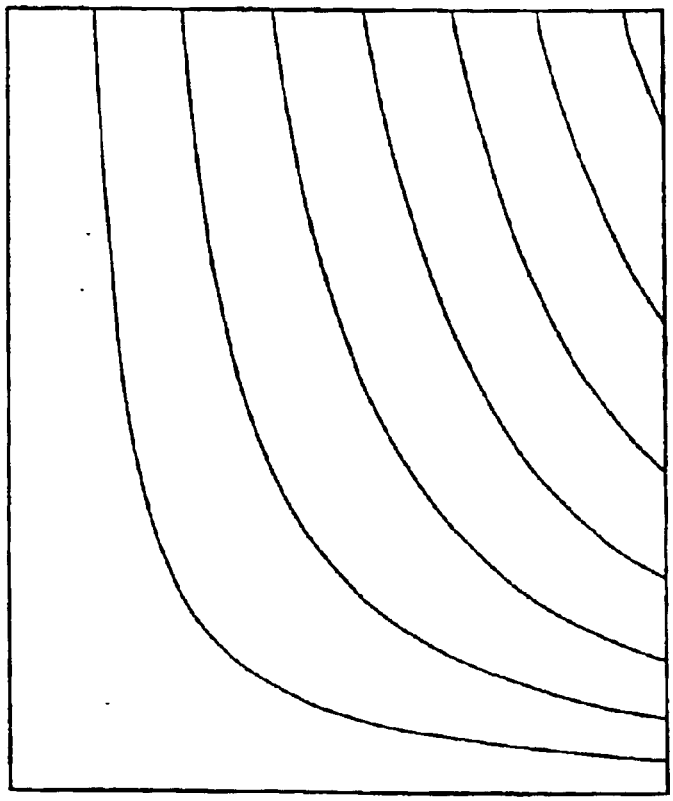
FIG. 11*b* shows the contours of a number of equipotentials on a side wall of the analyser of FIG. 11*a*.

Alternatively, the side walls may be made from electrically insulating material on the surface of which is deposited a series of electrically conductive lines or strips which are shaped to conform to the contours of the equipotentials intersecting the side walls, and to each of which is applied the required potential. This is illustrated in FIG. 11*b*.

In a yet further alternative approach, instead of using an electrically insulating substrate the electrically conductive lines or strips may be self-supporting. It will be appreciated that the field defining elements described with reference to any of FIGS. 1 to 10 can be modified for use over a relatively narrow angular range in azimuth in the manner described with reference to FIG. 11, for example.

TABLE 1

| E | $\theta_0$ | $Z_i/R_1$ | $Edz_i/dE$ | ΔE |
|---|---|---|---|---|
| 125 | 0.4674 | 1.455 | 0.855 | 0.22 |
| 200 | 0.4691 | 1.876 | 1.102 | 0.23 |
| 300 | 0.4703 | 2.349 | 1.380 | 0.23 |
| 500 | 0.4715 | 3.140 | 1.845 | 0.24 |
| 800 | 0.4722 | 4.136 | 2.430 | 0.37 |
| 1250 | 0.4719 | 5.416 | 3.182 | 0.51 |
| 2000 | 0.4704 | 7.262 | 4.267 | 1.41 |
| 3000 | 0.4679 | 9.429 | 5.540 | 4.34 |

TABLE 2

| E | $\theta_0$ | $z_1/R_1$ | $Edz_1/dE$ |
|---|---|---|---|
| 125 | 0.4760 | 1.46 | 0.780 |
| 200 | 0.4758 | 1.882 | 1.028 |
| 300 | 0.4762 | 2.354 | 1.318 |
| 500 | 0.4766 | 3.146 | 1.812 |
| 800 | 0.4766 | 4.142 | 2.460 |
| 1250 | 0.4758 | 5.422 | 3.329 |
| 2000 | 0.4740 | 7.267 | 4.622 |

TABLE 3

| $z_5/R_1$ | E | $\theta_0$ | $z_i/R_1$ |
|---|---|---|---|
| −2 | 43.5 | 0.435 | 1.136 |
| −1.5 | 123 | 0.471 | 1.483 |
| −1 | 201 | 0.519 | 2.001 |
| 0 | 410 | 0.574 | 3.144 |
| 1 | 630 | 0.606 | 4.230 |
| 2 | 854 | 0.622 | 5.287 |
| 3 | 1082 | 0.635 | 6.328 |
| 4 | 1315 | 0.642 | 7.367 |

TABLE 4

| $z_5/R_1$ | E | $\theta_0$ | $z_i/R_1$ |
|---|---|---|---|
| −2.5 | 1206 | 0.359 | 5.886 |
| −2.0 | 1223 | 0.386 | 5.988 |
| −1.0 | 1356 | 0.441 | 6.448 |
| 0.0 | 1556 | 0.494 | 7.102 |
| 1.0 | 1763 | 0.538 | 7.807 |
| 2.0 | 2009 | 0.573 | 8.630 |
| 3.0 | 2281 | 0.598 | 9.471 |
| 5.0 | 2862 | 0.631 | 11.35 |

TABLE 5

| | | | | | | | | |
|---|---|---|---|---|---|---|---|---|
| r | 1 | 10 | 10 | 10 | 6 | 3 | 1 | 1 |
| z | 0 | 0 | 1.5 | 3 | 3 | 3 | 3 | 1.5 |
| V | $V_1$ | $V_1$ | $V_2$ | $V_3$ | $V_4$ | $V_5$ | $V_6$ | $V_7$ |
| Eqn(2) | 0 | 0 | −500 | −1000 | −778 | −477 | 0 | 0 |
| Emp | 0 | 0 | −291 | −1000 | −869 | −455 | 69 | −31 |

TABLE 6

| E | $\theta_0$ | $r_i$ | $c_2$ | $Edr_i/dE$ | $g_2$ |
|---|---|---|---|---|---|
| 56.6 | 1.0825 | 2.403 | −5.51 | 0.861 | 0.156 |
| 80 | 1.0744 | 2.731 | −7.61 | 1.048 | 0.138 |
| 113.1 | 1.0711 | 3.134 | −10.12 | 1.281 | 0.127 |
| 160 | 1.0700 | 3.629 | −12.92 | 1.575 | 0.122 |
| 226.3 | 1.0698 | 4.236 | −16.15 | 1.946 | 0.121 |
| 320 | 1.0695 | 4.985 | −19.73 | 2.416 | 0.123 |
| 452.5 | 1.0682 | 5.919 | −23.69 | 3.018 | 0.127 |
| 640 | 1.0653 | 7.103 | −28.49 | 3.801 | 0.133 |

TABLE 7

| $Z_5$ | E | $\theta_0$ | $r_1$ | $c_3$ | $Edr_i/dE$ | $g_3$ |
|---|---|---|---|---|---|---|
| −0.6 | 38.4 | 1.112 | 2.173 | 55.1 | 0.643 | 0.012 |
| −0.7 | 66.5 | 1.104 | 2.657 | 44.0 | 0.915 | 0.021 |
| −0.8 | 97.0 | 1.093 | 3.106 | 41.1 | 1.151 | 0.028 |
| −0.9 | 133.3 | 1.089 | 3.571 | 38.4 | 1.392 | 0.036 |
| −1.0 | 172.6 | 1.087 | 4.025 | 38.5 | 3.178 | 0.083 |

What is claimed is:

1. A charged particle energy analyser arranged to analyze charged particles having a range of energies, comprising:

electrostatic focusing means including inner and outer field defining means extending about an axis of the electrostatic focusing means over a predetermined range in azimuth, a charged particle source for directing said charged particles into an electrostatic focusing field generated, in use, by said electrostatic focusing means between said inner and outer field defining means, and detection means positioned to receive and detect charged particles focused by said electrostatic focusing means, wherein said electrostatic focusing field is defined by equipotentials which extend about said axis and which vary substantially linearly in the direction of said axis and which vary substantially logarithmically in the radial direction orthogonal to said axis, whereby charged particles having different energies are brought to a focus by the electrostatic focusing field at different discrete positions on a surface of the detection means.

2. An analyser as claimed in claim 1 wherein said surface of said detection means is transverse to said axis.

3. An analyser as claimed in claim 2 wherein said surface is orthogonal to said axis.

4. An analyser as claimed in claim 2 wherein said surface is planar.

5. An analyser as claimed in claim 2 wherein said surface is curved.

6. An analyser as claimed in claim 5 wherein said surface is conical.

7. An analyser as claimed in claim 2 wherein said surface is in a field-free region beyond the electrostatic focusing field.

8. An analyser as claimed in claim 1 wherein said charged particles having different energies are brought to a focus by the electrostatic focusing field at different discrete positions that are spaced apart from each other in the axial direction.

9. A charged particle energy analyser as claimed in claim 1 wherein said charged particle source directs said charged particles into said electrostatic focusing field over a predetermined angular range in elevation relative to said axis, and said predetermined angular range in elevation and/or the axial position of the charged particle source and/or the axial position of the electrostatic focusing field are set or adjustable for second-order focusing of the charged particles.

10. An analyser as claimed in claim 1 wherein said equipotentials are symmetrical about said axis.

11. An analyser as claimed in claim 1 wherein said outer field defining means is maintained, in use, at a potential relative to said inner field defining means.

12. An analyser as claimed in claim 1 wherein said inner field defining means and said outer field defining means comprise an inner cylinder and an outer cylinder respectively, wherein said inner cylinder is maintained, in use, at a uniform potential and said outer cylinder is maintained, in use, at potential varying monotonically in the axial direction.

13. An analyser as claimed in claim 12 wherein said potential varies linearly in the axial direction.

14. An analyser as claimed in claim 13 wherein said outer cylinder is made from electrically resistive material.

15. An analyser as claimed in claim 11 wherein said outer field defining means comprises a plurality of discrete field defining elements, each said element being maintained, in use, at a different respective potential with respect to said inner field defining means.

16. An analyser as claimed in claim 15 wherein each said field defining element has the form of a ring or hoop.

17. An analyser as claimed in claim 15 wherein each said field defining element has the form of a hollow, truncated cone.

18. An analyser as claimed in claim 11 wherein said outer field defining means comprises a plurality of discrete field defining elements each being made from electrically resistive material and being maintained, in use, at a respective potential which increases monotonically in the axial direction.

19. An analyser as claimed in claim 18 wherein each said element has the form of a cylinder.

20. An analyser as claimed in claim 18 wherein each said element has the form of a hollow, truncated cone.

21. An analyser as claimed in claim 1 including first and second end elements located at opposite ends of said inner and outer field defining means in respective planes orthogonal to said axis, each of said first and second end elements being maintained in use at a potential relative to said inner field defining means which varies logarithmically in the radial direction.

22. An analyser as claimed in claim 21 wherein each said end element is made from electrically resistive material.

23. An analyser as claimed in claim 21 wherein each said end element comprises a plurality of concentric electrically conductive rings each being maintained, in use, at a different respective potential.

24. An analyser as claimed in claim 21 wherein charged particles having different energies are brought to a focus by the electrostatic focusing field at different respective discrete positions in the plane of one of said first and second end elements.

25. An analyser as claimed in claim 1 wherein said electrostatic focusing means is so configured that the distribution of potential in said electrostatic focusing field is uniform as a function of azimuthal angle about said axis.

26. An analyser as claimed in claim 1 wherein said electrostatic focusing means is so configured that the distribution of potential in said electrostatic focusing field has n-fold rotational symmetry about said axis, where n is an integer.

27. An analyser as claimed in claim 11 wherein said inner field defining means and/or said outer field defining means has n-fold rotational symmetry about said axis, where n is an integer.

28. An analyser as claimed in claim 27 wherein said inner field defining means comprises a plurality of flat side surfaces having n-fold rotational symmetry about said axis, where n is the number of said surfaces.

29. An analyser as claimed in claim 28 wherein said charged particles are brought to a focus at discrete positions spaced apart from each other along one or more of said side surfaces and said surface of said detection means is located at said one or more side surfaces to detect the focused charged particles.

30. An analyser as claimed in claim 1 wherein said charged particles are brought to a focus at discrete positions spaced apart from each other along said inner field defining means and said surface of said detection means is located at and conforms to said inner field defining means to detect the focused charged particles.

31. An analyser as claimed in claim 1 wherein said charged particles are brought to a focus at said axis and said surface of said detection means is located on said axis to detect the focused charged particles.

32. An analyser as claimed in claim 1 wherein said charged particle source is located on said axis.

33. An analyser as claimed in claim 32 wherein said charged particle source comprises a target located on said axis and means for directing radiation onto said target whereby to generate said charged particles.

34. An analyser as claimed in claim 1 wherein said charged particle source comprises a target located on said axis and means for directing radiation onto said target whereby to generate said charged particles, said target and said means for directing radiation being located within said inner field defining means.

35. An analyser as claimed in claim 33 wherein said means for directing radiation is an electron gun.

36. An analyser as claimed in claim 1 wherein said charged particle source directs charged particles into said electrostatic focusing field over a predetermined angular range in azimuth about said axis.

37. An analyser as claimed in claim 36 wherein said charged particle source directs said charged particles into said electrostatic focusing field over the entire (360°) angular range in azimuth.

38. An analyser as claimed in claim 1 wherein said charged particle source directs charged particles into said electrostatic focusing field over two or more discrete angular ranges in azimuth about said axis.

39. An analyser as claimed in claim 1 wherein said charged particle source directs charged particles into said electrostatic focusing field over one or more predetermined angular range in azimuth about said axis, said charged particles being admitted to the electrostatic focusing field by one or more windows in the inner field defining means.

40. An analyser as claimed in claim 39 wherein the or each said window has the form of an electrically conductive grid or mesh.

41. An analyser as claimed in claim 1 wherein said charged particle source directs charged particles into said electrostatic focusing field over two or more predetermined angular range in azimuth about said axis, and said detection means is so configured and arranged as to detect charged particles derived from each said angular range.

42. An analyser as claimed in claim 1 wherein said detection means comprises one or more detector selected from a multi channel array detector, a microsphere array detector and a position-sensitive resistive plate detector.

43. An analyser as claimed in claim 42 wherein said one or more detector incorporates a phosphor-coated detection plate.

44. An analyser as claimed in claim 1 including means for adjusting the axial position of said charged particle source.

45. An analyser as claimed in claim 11 including means for adjusting said potential whereby to vary the axial position of the electrostatic focusing field relative to said charged particle source.

46. An analyser as claimed in claim 1 wherein said charged particle source includes aperture means for directing charged particles into said electrostatic focusing field over a predetermined angular range in elevation relative to said axis.

47. An analyser as claimed in claim 46 wherein said predetermined angular range in elevation and/or the axial position of said charged particle source and/or the axial position of the electrostatic focusing field are set or adjustable for second-order focusing of charged particles.

48. An analyser as claimed in claim 1 wherein said charged particle source directs said charged particles from a location or locations offset from said axis.

49. An analyser as claimed in claim 48 wherein said charged particle source includes means for focusing charged particles at said location or locations.

50. An analyser as claimed in claim 1 wherein said charged particle source and said detection means are both located between said axis and said inner field defining means.

51. An analyser as claimed in claim 1 wherein said charged particles are brought to a focus at discrete positions spaced apart from each other along said inner field defining means and said detection means comprises a detector located radially inwards or radially outwards of the inner field defining means and means for focusing said focused charged particles onto said surface of said detector.

52. An analyser as claimed in claim 1 wherein said charged particle source includes a real source located at a first position and means for focusing charged particles produced by said real source at a second position different from said first position whereby said charged particle source creates a virtual source at said second position from where said charged particles are directed into said electrostatic focusing field.

53. An analyser as claimed in claim 1 wherein said outer field defining means comprises a curved plate having rotational symmetry about said axis.

54. An analyser as claimed in claim 53 wherein said curved plate is maintained at a uniform potential.

55. An analyser as claimed in claim 24 wherein said one of said first or second end elements is maintained at zero potential.

56. A method for operating a charged particle energy analyser as claimed in claim 1 comprising the steps of applying voltage to said electrostatic focusing means in order to obtain operation in the first-order focusing mode within a predetermined energy range and scaling the applied voltage in order to obtain operation in the second-order focusing mode at a selected narrower energy range within said predetermined energy range.

57. An analyser as claimed in claim 1 wherein said predetermined range in azimuth is the entire (360°) azimuthal range.

58. An analyser as claimed in claim 1 wherein said inner and outer field defining means comprises an inner cylindrical segment and an outer cylindrical segment respectively, wherein said inner and outer cylindrical segments extend over a predetermined angular range in azimuth and said outer cylindrical segment is maintained, in use, at a potential varying linearly in the axial direction.

59. An analyser as claimed in claim 58 wherein the longitudinal side edges of the inner and outer cylindrical segments are joined by side walls.

60. An analyser as claimed in claim 59 wherein said side walls are adapted to define a predetermined potential distribution over their inward facing surfaces.

* * * * *